United States Patent [19]

Schwartz et al.

[11] 4,435,211

[45] Mar. 6, 1984

[54] PROCESS OF BLOWING HIGH-OXYGEN GASES INTO A MOLTEN BATH WHICH CONTAINS NON-FERROUS METALS

[75] Inventors: Werner Schwartz, Buchholz; Peter Fischer, Bad Vilbel, both of Fed. Rep. of Germany

[73] Assignee: Metallgesellschaft Aktiengesellschaft, Frankfurt am Main, Fed. Rep. of Germany

[21] Appl. No.: 326,297

[22] Filed: Dec. 1, 1981

[30] Foreign Application Priority Data

Dec. 5, 1980 [DE] Fed. Rep. of Germany ..... 3045992

[51] Int. Cl.[3] ..... C22B 13/00

[52] U.S. Cl. ..... 75/62; 75/77; 266/47

[58] Field of Search ..... 75/62, 77; 266/46, 47

[56] References Cited

U.S. PATENT DOCUMENTS

| | | | |
|---|---|---|---|
| 443,758 | 12/1890 | Gaylord | 266/47 |
| 3,892,559 | 7/1975 | Quarm | 75/21 |
| 4,097,028 | 6/1978 | Langhammer | 266/47 |

*Primary Examiner*—M. J. Andrews

*Attorney, Agent, or Firm*—Sprung, Horn, Kramer & Woods

[57] ABSTRACT

The gases are injected through double-tube nozzles which extend through the wall of the reactor into the molten bath. A cooling protective fluid is injected through one tube of each double-tube nozzle. To reduce or avoid a wear of the double-tube nozzles and the surrounding brickwork, the flow rate of the protective fluid is so selected in dependence on the composition of the slag and on the difference between the temperature of the slag and its solidification point that crusts will be formed on the nozzles but will not exceed a desired thickness.

18 Claims, 1 Drawing Figure

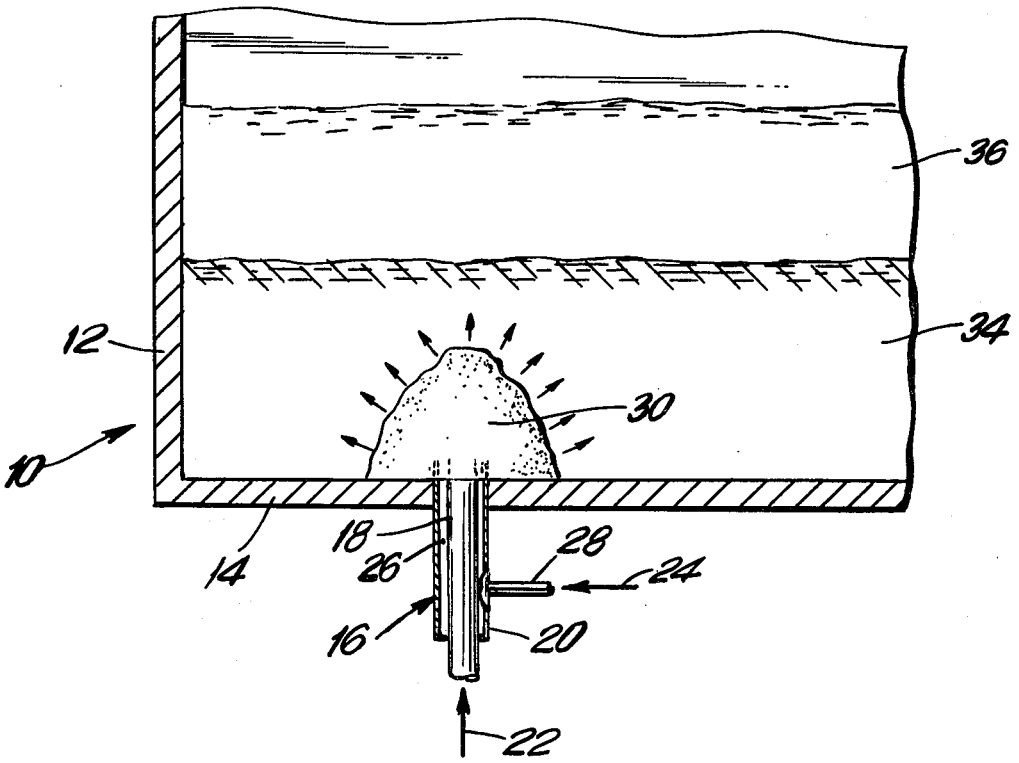
36
34
12
30
10
14
18
26
28
24
16
20
22

PROCESS OF BLOWING HIGH-OXYGEN GASES INTO A MOLTEN BATH WHICH CONTAINS NON-FERROUS METALS

BACKGROUND OF THE INVENTION

1. Field of the Invention

This invention relates to a process of blowing high-oxygen gases into a molten bath which contains non-ferrous metals through double-tube nozzles, which extend through the reactor wall into the molten bath, wherein a protective cooling fluid is injected through one tube of each double-tube nozzle.

2. Discussion of Prior Art

In some pyrometallurgical processes of producing non-ferrous metals, high-oxygen gases consisting of commercially pure oxygen or oxygen-enriched gases are blown into a molten bath. Such processes are used, e.g., to extract nonferrous metals or matte phases enriched with non-ferrous metals from sulfide ores or to refine molten baths which contain non-ferrous metals. The high-oxygen gases are blown into the molten bath through nozzles extending through the brickwork of a reactor from the bottom or the sides thereof. A protective fluid is used to protect the nozzles and the surrounding brickwork from the high temperatures which occur at the nozzles. Double-tube nozzles are used for this purpose. In general, the high-oxygen gas is blown through the inner tube and the cooling protective fluid is blown through the annulus between the inner and the outer tubes. Such processes are known, e.g., from German Offenlegungsschrift Nos. 24 17 979 and 28 07 964.

Such double-tube nozzles and the injection of high-oxygen gases together with a protective fluid have been used first in the steel industry (German Patent Publication Nos. 15 83 968; 17 83 149; 17 58 816; 20 52 988; 22 59 276; 14 33 398; British No. 1,253,581; Austrian No. 265,341). Efforts have always been made to prevent formation of crusts on the nozzles because such crusts have undesired effects on the motion of the bath, the erosion of the brickwork and safety in operation. Only where water-cooled single nozzles are used is it desired to provide a layer of solidified iron or metal in order to protect the cooled portion of the nozzle tip from destruction. The previous uses of double-tube nozzles in non-ferrous metallurgy to inject high-oxygen gases together with a protective fluid (German Offenlegungsschrift Nos. 24 17 979 and 28 07 964; British No. 1,414,769) were obviously based on the same assumptions. But that practice results in a considerable wear of the nozzles and the surrounding brickwork.

It is an object of the invention to reduce or avoid the wear of the double-tube nozzles and the surrounding brickwork in processes of blowing high-oxygen gases and protective fluids into molten baths which contain non-ferrous metals.

SUMMARY OF THE INVENTION

This object is accomplished, according to the invention, by regulating the flow rate of the protective fluid in dependence on the composition of the slag and on the difference between the temperature of the slag and its solidification point. As a result one can perform the process such that crusts form on the nozzles but the thickness does not exceed a desired or predetermined thickness.

It has been discovered that the thickness of the crusts on the nozzles and the surrounding brickwork can be so selected that the desired protection is obtained and that the crusts have a good gas permeability such that there is good distribution of gas through the crusts. The thickness depends on the operating conditions of the process and is empirically determined. The required flow rate of the protective fluid remains substantially constant in continuous processes whereas it must be controlled in relatively large ranges in batch processes.

BRIEF DESCRIPTION OF THE DRAWING

The drawing is an elevational view in partial cross-section depicting a reactor having a double-tube nozzle with a porous crust formed thereon.

DETAIL DESCRIPTION OF THE INVENTION

Referring to the drawing in detail in which like numerals indicate like elements, there is shown a reactor 10 having a side wall 12 and a bottom wall 14. Disposed within bottom wall 12 is a double-tube nozzle 16 composed of inner tube 18 and outer tube 20. Oxygen containing gas represented by arrow 22 enters the reactor 10 via inner tube 18. Protective cooling fluid represented by arrow 24 enters the annulus 26 formed by tubes 18 and 20 via conduit 28 which is connected to outer pipe 20. A porous crust 30 forms inside reactor 10 on the nozzle 16. Within reactor 10 is a metal layer 34 and a slag layer 36.

The protective fluids can comprise combustible and non-combustible gases or liquids, such as nitrogen, $SO_2$, $CO_2$, water vapor, hydrocarbons. Their selection depends on the process conditions. The flow rate of the protective fluid required to form the crusts depends on the solidification point of the slag or of high-melting constituents of the slag and on the difference between the temperature of the slag and said solidification point before the slag is contacted by the protective fluid. The outlet aperture for the protective fluid should be as small as possible and the protective fluid should be injected under high pressure, e.g., above 6 bars, so that the required flow rate of the protective fluid will be minimized.

According to a preferred further feature, the composition and temperature of the slag are so selected that a slight local cooling of the slag at the nozzles results in a temperature drop substantially below the crystallization temperature of high-melting constituents which were originally in solution in the slag. The composition of the slag is so selected that the slag is almost saturated with high-melting compounds, such as magnetite, calcium silicates or similar compounds. This is accomplished by the use of a slag having a suitable chemical composition, by the provision of a suitable oxidation potential, which depends on the desired metal-sulfide-oxide equilibrium of the non-ferrous metal to be recovered, and by the selection of a suitable temperature for the high-melting compounds. This results in a good formation of crusts by protective fluids at low flow rates.

According to a further preferred feature, the agitating action of the gases injected through the nozzles is so selected that a slag-metal emulsion will reach the nozzles regardless of the height of the metallic bath layer on the bottom of the reactor. The agitating action of the injected gases can be selected by the adjustment of a suitable pressure or flow rate of the gases and/or in that the height of the metallic layer over the nozzles is suitably adjusted. This also results in a good formation of crusts.

According to a further preferred feature, the thickness of the crusts is controlled in that the pressure rise of the flowing protective fluid and/or the high-oxygen gas over the original pressure is maintained at a desired value. The formation of crusts results in a pressure rise over the pressure that existed before the formation of crusts. The magnitude of the pressure rise depends on the thickness and the shape of the crusts. The magnitude of the pressure rise which corresponds to the desired thickness of the crusts is empirically determined and maintained. A pressure rise of about 0.1 to 0.5 bar is sufficient in most cases. This permits a simple control of the thickness of the crusts although a direct observation is not possible.

According to a further preferred feature of the invention, the pressure is constantly maintained at the desired value. Only the pressure is maintained constant and the volume is adjusted itself to the corresponding value. This results in a particularly simple and effective control of the thickness of the crusts.

According to a further preferred feature, the reactor is provided in dependence on the composition of the slag and on the temperature with such brickwork that a constant film of high-melting constituents will form on the brickwork. Such a brickwork is selected that the radiation of heat causes the slag to cool on the inside so that a thin crust film forms, which protects also the brick work adjacent to the nozzles, where no crusts are formed under the direct action of the protective fluid.

The invention will be explained more fully with reference to examples.

EXAMPLES

The Examples relate to the continuous oxidation of sulfide concentrate in a reactor which had a refractory lining and consisted of a horizontal cylinder having a length of 4.50 meters and a diameter of 1.80 meters. Fluxes were added to the sulfide concentrates in order to obtain slags having a predetermined chemical composition which is desirable in carrying out the process according to the invention. The reactor was provided with 3 double-tube nozzles having inner tubes 10 mm in diameter and with a propane-oxygen auxiliary burner for influencing the temperature of the molten bath regardless of the chemical-metallurgical reactions being performed.

The Examples are restricted to the oxidation of sulfide lead concentrates. As the resulting slag owing to their lead oxide content exert a particularly agressive action on all metallic and ceramic materials known in technology, the measures adopted in the Examples for the protection of the nozzles and brickwork of the reactors can readily be used in connection with the melting of various other precursors and intermediate products which contain non-ferrous metals, inclusive of concentrates, mattes, speisses, slags, dusts and muds, which contain copper, nickel, cobalt, zinc, lead, tin, antimony or bismuth.

Mixtures having the following compositions were used, in general: 56.1% Pb, 3.2% Zn, 7.2% FeO, 3.9% Ca O, 0.6% MgO, 0.7% $Al_2O_3$, 10.3% $SiO_2$ and 11.2% S. As a rule, the mixture being melted had such an oxidation potential that a magnetite-containing slag which contained 63 to 66% lead was formed in addition to low-sulfur metallic lead (less than 1%S). The metallic lead which had formed collected at the bottom of the reactor in a layer 200 mm high and was periodically tapped. The slag was continuously withdrawn.

EXAMPLE 1

At a slag temperature of 1000° C., the existing double-tube nozzles were supplied with oxygen at a constant flow rate and with nitrogen as a protective fluid at different flow rates. The nozzles were pulled and measured at the end of the test (No. 1):

| Nozzle | Protective gas pressure bars | Wear of Nozzles due to oxidation mm | Velocity of wear due to oxidation mm/h |
|---|---|---|---|
| 1 | 5.2 | 35 | 2.3 |
| 2 | 6.9 | 14 | 0.9 |
| 3 | 8.4 | 0 | 0 |

It was found that the tip of the third nozzle had been covered with a conical porous crust having a height of about 30 mm and a base diameter of about 50 mm and consisting of 70% magnetite and 30% of various silicates. The brickwork adjacent to the two other nozzle tips showed signs of corrosion in the form of funnels, which were about 50 to 100 mm in diameter respectively, and had a depth corresponding to the oxidation of the nozzles. The brickwork adjacent to the third nozzle had been entirely preserved.

EXAMPLE 2

To investigate the influence of an over-heating of the slag, three tests were conducted with the slag at different temperatures. The velocity of flow of the protective gas selected in Example 1 for the second nozzle (6.9 bars of nitrogen pressure) was adjusted. The nozzles were also pulled and measured at the end of the tests:

| Test | Temperature °C. | Wear of nozzles due to oxidation mm | Velocity of wear due to oxidation mm/h |
|---|---|---|---|
| 2 | 930 | 0 | 0 |
| 3 | 1000 | 14 | 0.9 |
| 4 | 1090 | 31 | 2.1 |

It was found that none of the three nozzles and no part of the surrounding brickwork had been corroded in Test 2. Conical porous crusts of magnetic and silicate had again formed in front of the nozzle tips and had heights between 30 and 35 mm and base diameters between 50 and 60 mm. The brickwork near the nozzles used in Tests 3 and 4 showed the signs of corrosion described in Example 1.

EXAMPLE 3

By two additional tests it was shown that the previously explained protective mechanism for the nozzles and the surrounding brickwork will not be effective unless the slag used has a suitable composition.

For this purpose the reactor was filled for one test with a pure lead oxide slag (PbO) and for another test with a lead silicate slag having approximately the composition 2 $PbO.SiO_2$. In both tests, the slag was maintained at a slag temperature of 930° C. and the nozzles were supplied with oxygen and with nitrogen under a pressure of 6.9 bars. In these tests, no mixture of concentrate and fluxes was charged so that the slag composition was not changed. For this reason there was no bottom phase consisting of metallic lead. In neither of the two tests was it possible to produce a solid crust in front of the nozzle tips. After the end of the test, the nozzles and the surrounding brickwork were found to be almost destroyed.

| Test | Slag | Wear of nozzles due to oxidation mm | Velocity of wear due to oxidation mm/h |
|---|---|---|---|
| 5 | PbO | 300 | 200 |
| 6 | 2 PbO.$SiO_2$ | 180 | 64 |

EXAMPLE 4

In a further test (No. 7) it was found that the size of the crusts formed on the nozzle tips can easily be influenced by a control of the pressure of the protective fluid. For this purpose the reactor was operated substantially under the same conditions as in Test 2 (temperature 930° C.) but the three nozzles were operated at slightly different protective gas pressures: The nitrogen pressure was maintained constant at 6.7 bars as nozzle 1 and at 7.1 bars at nozzle 2. The nitrogen pressure at nozzle 3 was changed periodically between 6.7 and 7.1 bars in ten-minute intervals. After the test, neither the nozzles nor the surrounding brickwork had corroded but porous crusts differing widely in size had formed on the nozzle tips:

| Nozzle | Nitrogen pressure bars | Size of conical crusts height mm | base diameter mm |
|---|---|---|---|
| 1 | 6.7 | 10 | 30 |
| 2 | 7.1 | 50 | 80 |
| 3 | 6.7 to 7.1 | 30 | 50 |

Suitable and constant conditions regarding temperature, pressure of protective fluid, composition of slag and geometry at the nozzle outlets obviously result in a thermal equilibrium which causes porous crusts of defined shape and size to form.

EXAMPLE 5

In a last series of tests it was shown that the height of the metallic phase at the bottom has an influence on the formation of crusts on the tips of the nozzle. In one test (No. 8) the reactor was filled only with the magnetite-containing slag, into which oxygen and nitrogen (under a pressure of 6.9 bars) were blown while the slag was at a temperature of 930° C. No concentrate and fluxes were charged so that a bottom phase of metallic lead was not formed.

In another test (No. 9), metallic lead was charged to form a lead layer 400 MM high and this layer was maintained constant in that concentrate and fluxes were charged and metal was periodically tapped. In other respects, the same conditions as in Test 2 (temperature 930° C., nitrogen pressure 6.9 bars) were maintained as in Test 2.

After the tests, the nozzles and the surrounding brickwork were found to be entirely preserved but crusts differing in size had formed:

| Test | Height of lead layer mm | Size of conical crusts Height mm | base diameter mm |
|---|---|---|---|
| 8 | 0 | 55–65 | 80–100 |
| 2 | 200 | 30–35 | 50–60 |
| 9 | 400 | 10–15 | 20–30 |

It is apparent that the height of the metallic phase at the bottom must be taken into account if that metallic metal phase consists of a low-melting metal and it is desired to produce crusts having a predetermined shape and size.

In analogy to Example 4, in which a lead layer of 200 mm was maintained, the inherently undesired influence of the metallic phase at the bottom on the formation of crusts at the tips can be compensated by the use of protective fluid under a higher pressure.

The advantages afforded by the invention reside in that the nozzles and the surrounding brickwork are protected by simple means from chemical attack and from an erosion by the molten phase and that the flow rate of protective fluid can be minimized whereas a good distribution of gas in the molten bath is effected.

The flow rate of the protective fluid is so selected that slag or high-melting constituents of the slag are cooled below their solidification temperature in the vicinity of the nozzles, that porous crusts are formed on the nozzles and that the thickness of these crusts does not exceed a predetermined thickness. The necessary flow rate of the protective fluid depends on the solidification temperature of the slag or the high-melting components of the slag, the difference between the slag temperature before contact with the protective fluid and that solidification temperature and the cooling effect of the protective fluid. The slag composition and therewith the solidification point depends on the metallurgical process. Generally the slags have a composition of about 30% to 80% of $FeO+ZnO+MnO+Al_2O_3$, 0% to 30% of $CaO+MgO+BaO$ and 10% to 50% of $SiO_2$. For lead smelting processes the preferred composition is 40% to 50% of $FeO+ZnO+MnO+Al_2O_3$, 10% to 20% of $Ca\,O+MgO+BaO$ and 30% to 40% of $SiO_2$. For copper smelting processes the preferred composition is 65% to 75% of $FeO+ZnO+MnO+Al_2O_3$, 5% to 10% of $CaO+MgO+BaO$ and 15% to 25% of $SiO_2$. The slag temperature before contact with the protective fluid should not exceed the solification point by more than about 300° C. and preferably by not more than 50° to 100° C. The necessary flow rate of the protective fluid depends further on the form and diameter of the nozzle. If $N_2$ is used as a protective fluid, then about 10% to 40% $N_2$ and preferably 15% to 20% $N_2$ related to the oxygen volume are blown through the nozzle. If $CH_4$ is the protective fluid, then about 1% to 20% $CH_4$ and preferably 2% to 5% $CH_4$ related to the oxygen volume are blown through the nozzle. The height of the metallic layer over the nozzles is 2 to 100 cm and preferably 10 to 20 cm. The height of the porous crusts should not exceed 20 cm and is preferably adjusted to 5 to 10 cm.

What is claimed is:

1. In a process of blowing high-oxygen gases into a reactor comprising a reactor wall and containing within said wall a molten bath which contains non-ferrous metals, said blowing through double-tube nozzles, each of said nozzles terminating in a tip, said nozzles extend through the reactor wall into the molten bath, wherein a protective cooling fluid consisting essentially of a gas or liquid is injected through one tube of each double-tube nozzle, the improvement which comprises employing a flow rate of the protective fluid relative to the composition of the slag and the difference between the temperature of the slag and its solidification point, such that a gas permeable conical porous crust forms over the tip of the nozzles and regulating such flow rate so that the size of the crust does not exceed a predetermined size.

2. A process according to claim 1, wherein the composition and temperature of the slag are so selected that a slight local cooling of the slag at the nozzles results in a temperature drop substantially below the crystallization temperature of high-melting constituents which were originally in solution in the slag.

3. A process according to claim 1, wherein the agitating action of the gases or liquids injected through the nozzles is so selected that a slag-metal emulstion reaches the nozzles, regardless of the height of any metallic bath layer on the bottom of the reactor.

4. A process according to claim 2 or 3, wherein the thickness of the crusts is controlled by maintaining a pressure rise for the flowing protective fluid and/or oxygen gas over the original pressure at a pre-determined value.

5. A process according to claim 4, wherein the pressure is constantly maintained at the pre-determined value.

6. A process according to claim 1, wherein brickwork surrounds the inner wall of the reactor and the reactor is maintained such that the composition of the slag and the temperature of the brickwork are such that a constant film of

7. A process according to claim 1 wherein the protective cooling fluid is selected from the group consisting of nitrogen, sulfur dioxide, carbon dioxide, water vapor and hydrocarbons.

8. A process according to claim 1 wherein the protective cooling fluid is injected at a pressure of greater than 6 bars.

9. A process according to claim 1 wherein the height of the porous crust is between about 5 mm and about 20 mm.

10. A process according to claim 9 wherein the height of the porous crust is between about 5 mm and 10 mm.

11. A process according to claim 1 wherein the base diameter of the porous crust is between about 20 mm and about 100 mm.

12. A process according to claim 1 wherein there is a metallic layer above the nozzles, said layer having a height above the nozzles of between about 2 cm and 100 cm.

13. A process according to claim 12 wherein said height is between about 10 cm and about 20 cm.

14. A process according to claim 1 wherein the porous crust contains high-melting compounds selected from the group consisting of magnetite and silicates.

15. A process according to claim 1 wherein the slag has the following composition:

| | |
|---|---|
| $FeO + ZnO + MnO + Al_2O_3$ | 30 wt. % to 80 wt. % |
| $CaO + MgO + BaO$ | 0 wt. % to 30 wt. % |
| $SiO_2$ | 10 wt. % to 50 wt. %. |

16. A process according to claim 1 wherein the temperature of the slag before contact with the protective cooling fluid does not exceed the solidification point of the slag by more than 300° C.

17. A process according to claim 16 wherein said temperature does not exceed the solidification point of the slag by more than 50° C. to 100° C.

18. A process according to claim 4 wherein the pressure rise is between about 0.1 bar and about 0.5 bar.

* * * * *

UNITED STATES PATENT AND TRADEMARK OFFICE

CERTIFICATE OF CORRECTION

PATENT NO. : 4,435,211

DATED : March 6, 1984

INVENTOR(S) : Werner Schwartz et al

It is certified that error appears in the above-identified patent and that said Letters Patent is hereby corrected as shown below:

| | |
|---|---|
| Col. 2, line 18 | After "10" insert -- , -- |
| Col. 6, line 47 | Delete "solification" and substitute --solidification-- |
| Col. 7, line 33 | After "of" insert --high-melting constituents forms on the brickwork.-- |

Signed and Sealed this

*Second* Day of *October 1984*

[SEAL]

*Attest:*

GERALD J. MOSSINGHOFF

*Attesting Officer*

*Commissioner of Patents and Trademarks*